US005176290A

United States Patent [19]

Schwarzli

[11] Patent Number: 5,176,290

[45] Date of Patent: Jan. 5, 1993

[54] COIN OPERATED VENDING MACHINE

[75] Inventor: Josef W. Schwarzli, Stouffville, Canada

[73] Assignee: Machine-O-Matic Limited, Newmarket, Canada

[21] Appl. No.: 778,264

[22] Filed: Oct. 17, 1991

[51] Int. Cl.[5] ..... G07F 11/00

[52] U.S. Cl. ..... 221/203; 221/200; 221/265

[58] Field of Search ..... 221/200, 202, 203, 168, 221/265; 453/196, 12, 13; 222/196

[56] References Cited

U.S. PATENT DOCUMENTS 1,558,398 10/1925 Rose ..... 221/200
1,739,970 12/1929 Kauffman ..... 221/203
2,855,128 10/1958 Cookson et al. ..... 221/168
3,894,657 7/1975 Eckmayr ..... 221/265
4,534,492 8/1985 Schwarzli .

FOREIGN PATENT DOCUMENTS 659265 1/1964 Italy ..... 221/200

*Primary Examiner*—H. Grant Skaggs
*Attorney, Agent, or Firm*—Ridout & Maybee

[57] ABSTRACT

An improvement in a coin operated vending machine for vending bulk articles comprises means for deflecting loose articles away from the entrance to the dispensing aperture. The means comprises a resilient rolling member, extending across an entry notch to a housing shielding the aperture, and rotating in a direction opposite to the direction of revolution of an advancing dispensing wheel, thus gripping and ejecting loose articles in the vicinity of the entry notch.

20 Claims, 5 Drawing Sheets

COIN OPERATED VENDING MACHINE

FIELD OF THE INVENTION

The present invention relates to a coin operated vending machine. In particular, the present invention relates to an improvement in the dispensing apparatus of a coin operated vending machine for dispensing bulk merchandise.

BACKGROUND OF THE INVENTION

Coin operated vending machines for dispensing bulk merchandise, so-called "bulk vendors", are widely used to dispense small vendible items. The dispensing mechanism utilized in conventional bulk vendors requires that the merchandise being dispensed have a relatively uniform configuration approximating a sphere or a spheroid. Thus, merchandise such as gumballs are ideal for vending from a bulk vendor, because of their smooth spherical configuration. However, dispensing non-spherical articles such as packages of chewing gum, novelty items and the like from a bulk vendor requires that each article be individually packaged in a rigid capsule of more or less spherical or spheroidal configuration.

A typical bulk vendor of the type heretofore known is described in U.S. Pat. No. 4,534,492, the specification of which is incorporated herein by reference. The conventional dispensing mechanism utilized in bulk vendors of this type includes means positioned above a revolving dispensing wheel, which permits the passage through a dispensing aperture of only those items carried in containers formed in the dispensing wheel while excluding other loose articles contained in the product bin. Such means conventionally comprises a housing having a notch facing opposite to the direction of revolution of the dispensing wheel. An article carried in one of the containers formed in the dispensing wheel passes through the notch as the wheel advances, and as the container comes into alignment with the dispensing aperture the article is dispensed through a delivery chute, while loose articles contained in the product bin are deflected away from the dispensing aperture by the housing. Thus, for each coin inserted the bulk vendor dispenses only the article or articles carried in a single container of the dispensing wheel.

To assist in deflecting loose articles away from the aperture, a series of resiliently flexible members, typically springs, have been used to form a resilient curtain across the entry notch in the housing. An article seated in a container will deflect the springs sufficiently to enable passage of the article through the entry notch to the interior of the housing, permitting access to the dispensing aperture, while other loose articles contained in the product bin cannot deflect the springs sufficiently to enter the housing and are thus deflected over the exterior of the housing and remain in the product bin.

The main disadvantage to such conventional bulk vendors is that they are useful only for dispensing articles comprising a rigid capsule. Soft capsules carried on top of the dispensing wheel, entrained in the flow of product outside of the containers, tend to deform as the springs are deflected, and partially enter the entry notch along with an article carried in the container. Because the soft capsule is flexible, rather than being deflected over the housing as the dispensing wheel revolves the article is forced into the notch. This deflects the springs toward the inside of the housing, forming a "V"-shaped entry passage which converges in the direction of revolution of the dispensing wheel. As the wheel advances, the loose article becomes wedged against the dispensing wheel, crushing the capsule of both the article carried in the container and the loose article carried on top of the dispensing wheel. The soft capsule is easily deformed and collapsed in the notch, blocking the entry to the housing, and eventually jams the vendor. Since the dispensing wheel revolves in only one direction, the crushed article can only be removed by maintenance personnel, until which time the vendor remains out of service. The merchandise contained in the capsule can be mutilated beyond salvage in the process.

The rigid capsule typically used to package non-spherical vendible articles is formed in two portions. The article is deposited into the receptacle portion and the closure portion is then manually attached. The thickness of plastic required to maintain rigidity in the capsule, and the need to manually seal the portions of the capsule together, give rise to considerable expense in the production of vendible articles. This increases the cost of each article dispensed from the vendor. Moreover, since the purchaser's interest is in the article within the capsule, the capsule itself is generally discarded after purchase, which results in considerable wastage of non-biodegradable materials.

It is accordingly extremely advantageous to be able to dispense from a bulk vendor non-spherical merchandise packaged in a soft plastic capsule. A typical soft capsule is composed of polystyrene and has a vacuum formed receptacle portion into which the merchandise is deposited. The capsule is sealed by heat sealing a plastic or metal foil closure portion onto the filled receptacle portion. The entire packaging process can thus be effected by machine, and the capsule itself is recyclable and utilizes considerably less plastic than the rigid capsules required by conventional bulk vendors. Overall the cost of packaging merchandise in the soft capsule can be one-third or less of the cost of packaging in a rigid capsule.

The present invention overcomes this disadvantage by providing a bulk vendor capable of dispensing merchandise contained in a soft capsule. This is accomplished by replacing the resilient flexible members forming a deflecting curtain over the entry notch with a resilient rolling member. The rolling member extends across the entry notch and rotates in opposition to the revolution of the dispensing wheel, preferably at a speed slightly greater than that of the dispensing wheel.

An article carried in the container of the dispensing wheel will pass underneath the rolling member with minimal deflection thereof. However, loose articles contained in the product bin, when urged toward the entry notch by the advancing dispensing wheel, are frictionally engaged by the rolling member and ejected over the top of the housing. By employing a resilient rolling member which rotates in opposition to the dispensing wheel, and thus actively ejecting loose articles away from the vicinity of the entry notch (rather than using resilient members which merely passively deflect articles away from the notch) the bulk vendor embodying this improvement is able to dispense merchandise in a soft capsule without jamming or deforming the capsule. The bulk vendor embodying this improvement is thus able to vend merchandise at a substantially lower cost than conventional bulk vendors, and results in considerably less wastage when the capsule is discarded by the purchaser.

SUMMARY OF THE INVENTION

The present invention provides an apparatus for ejecting free floating articles in a bulk vending machine from the vicinity of an entrance to a delivery chute, comprising a housing including a top and sides for shielding an aperture to the delivery chute, at least one side of the housing having an entry notch for permitting an article carried in a container to be delivered into the housing for dispensing through the aperture, a rolling member having resilient gripping means extending substantially across the notch, and means for rotating the rolling member in opposition to the direction of revolution of a dispensing wheel.

The present invention further provides a coin operated vending machine comprising a housing having a partition between the base and the top dividing the housing into an upper product bin and a lower cash box, the partition having an aperture defining an entrance to a delivery chute and having a spindle protruding upwardly from a central portion thereof, a dispensing wheel having a hub with bearing means at the centre thereof for engaging the spindle, a rim with a plurality of gear teeth about the circumference thereof, and retaining members provided between the hub and the rim defining a plurality of product openings in the wheel, a coin activated gear mechanism having a handle actuating a transmission gear engaging the teeth on the rim of the dispensing wheel, and means positioned above the dispensing wheel over the aperture for preventing loose articles in the product bin from being dispensed through the aperture, comprising a housing having a top and sides extending from an outer wall of the product bin to the spindle, the improvement comprising a rolling member having a shaft and resilient gripping means mounted across an entrance to the housing, the shaft being in a plane parallel to the plane of the dispensing wheel, and means for rotating the rolling member as the dispensing wheel revolves, in a direction opposite to the direction of revolution of the dispensing wheel.

BRIEF DESCRIPTION OF THE DRAWINGS

In drawings which illustrate by way of example only a preferred embodiment of the subject invention.

DETAILED DESCRIPTION OF THE INVENTION

Figure 1:
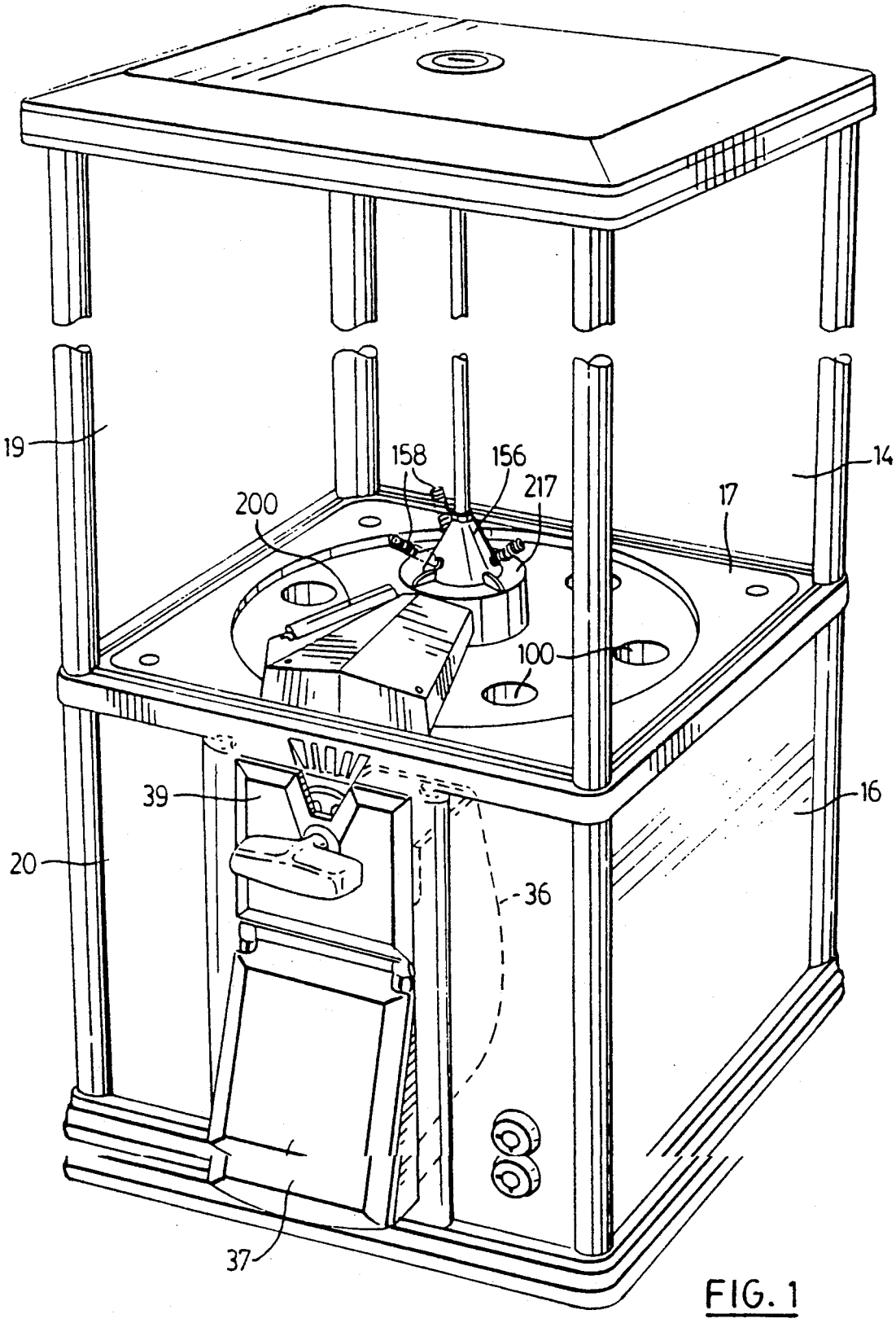
FIG. 1 is a partially exploded perspective view of a bulk vendor embodying the subject invention.

The bulk vendor embodying the subject invention is of the type described and illustrated in U.S. Pat. No. 4,534,492. As illustrated in FIG. 1, the vendor essentially comprises a housing 10 divided into an upper product bin 14 and a lower cash box 16 by a partition 17. A wall 20 of the cash box portion 16 is provided with a delivery chute 36 having an outer door 37, located beneath a coin operated gear mechanism 39.

Figure 2:
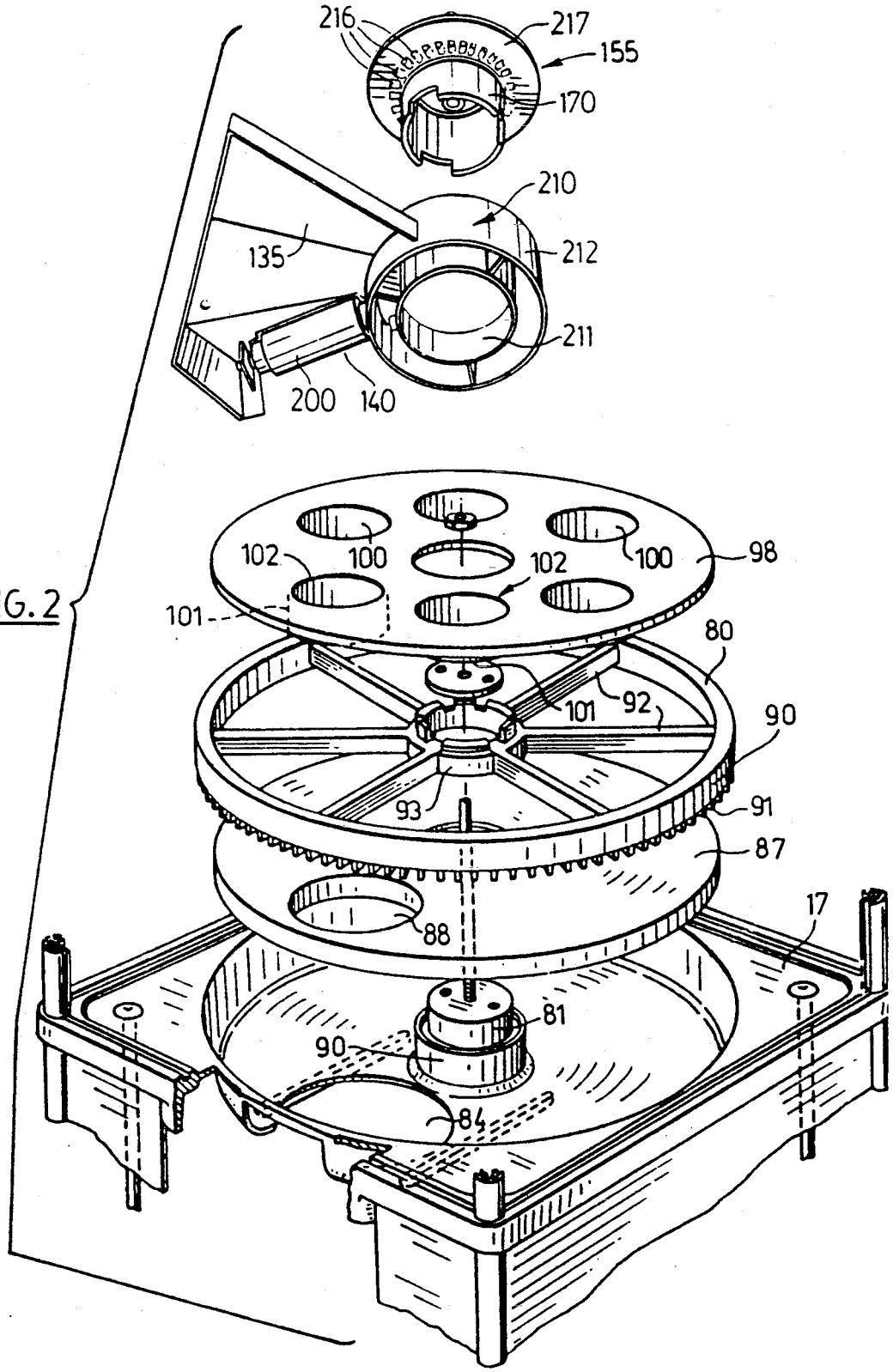
FIG. 2 is an exploded view of the dispensing wheel, hub and housing assembly of the subject invention.

The dispensing wheel, illustrated in exploded view in FIG. 2, comprises a wheel 80 having a rim 90 with teeth 91 meshing with a gear 116 of the coin operated gear mechanism 39, connected by retaining members such as spokes 92 to a hub 93 which engages a spindle 81 and thus revolves as the coin operated gear mechanism 39 is turned. Disposed thereon is a circular plate 98 having a plurality of product openings 100 for receiving vendible articles. Cylindrical retaining members 101 disposed underneath each of the product openings 100 form containers 102 for carrying the merchandise to be dispensed.

The dispensing wheel is disposed over a bottom plate 87 having an aperture 88 in alignment with an aperture 84 in the partition 17, leading to the delivery chute 36. The size of the aperture 84 may thus be reduced to accommodate the dispensing of smaller items, depending upon the size of the opening 88.

An agitator 155 includes agitating means 158 projecting from a conical shell 156. The agitator 155 includes a depending cylindrical flange 170 which engages the hub 93 of the wheel 80 such that the agitator 155 revolves with the dispensing wheel, in the manner described in U.S. Pat. No. 4,534,492.

To ensure that only the article (or set of articles) carried by a container 102 is dispensed with each full turn of the gear 116, corresponding to the insertion of a single coin into the coin operated gear mechanism 39, a housing 135 is secured to the partition 17 and extends from the upper wall portion 19 of the product bin 14 to the spindle 81, shielding the aperture 84 leading to the delivery chute 36. An entrance to the housing 135 such as an entry notch 140, of a height sufficient to provide clearance for an article carried in a container 102 to pass under the housing 135, is provided on the side of the housing 135 facing against the direction of revolution of the dispensing wheel.

Figure 3:
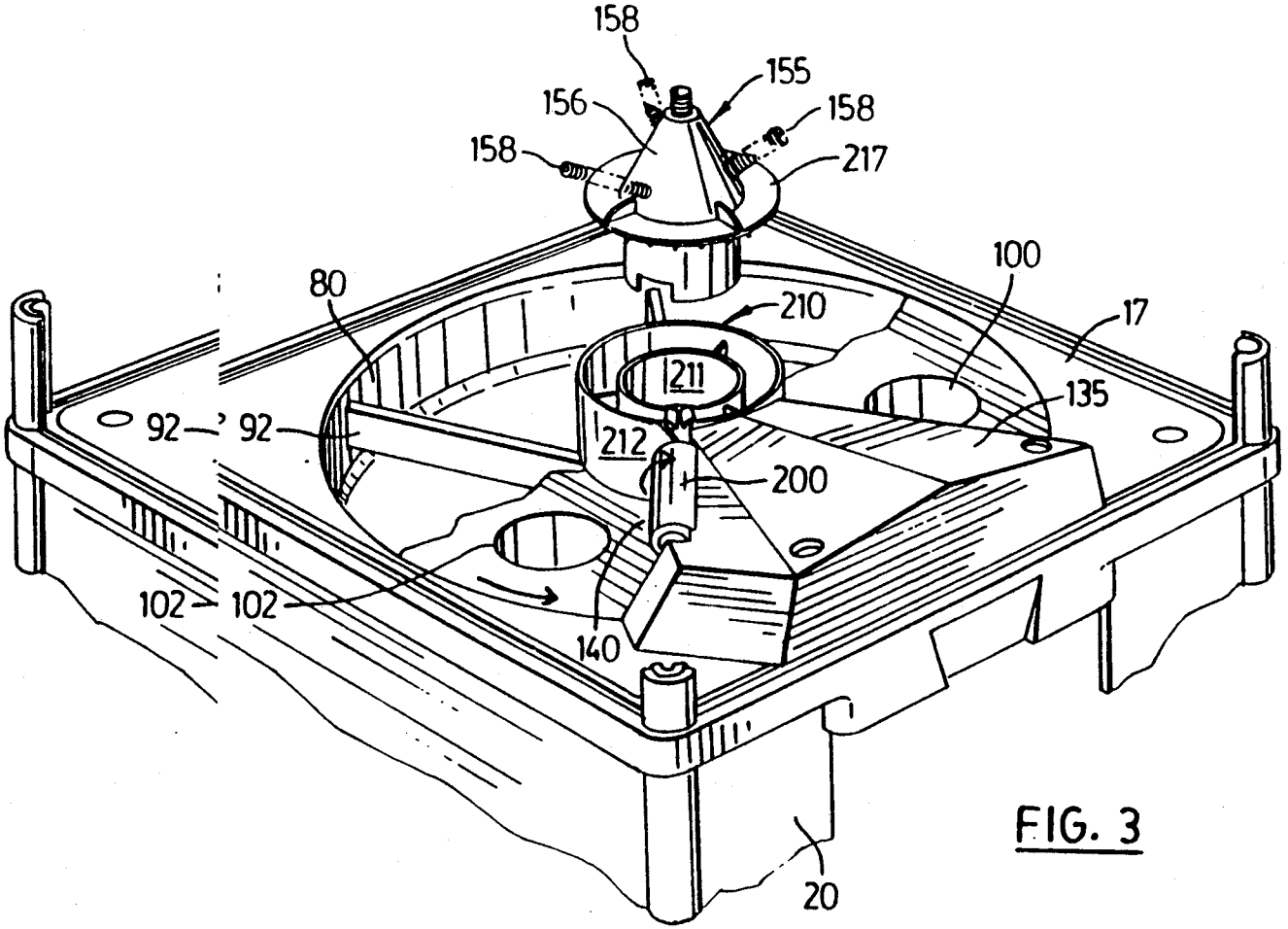
FIG. 3 is a partially exploded perspective view illustrating a preferred means for rotating the resilient rolling member of the present invention.
Figure 4:
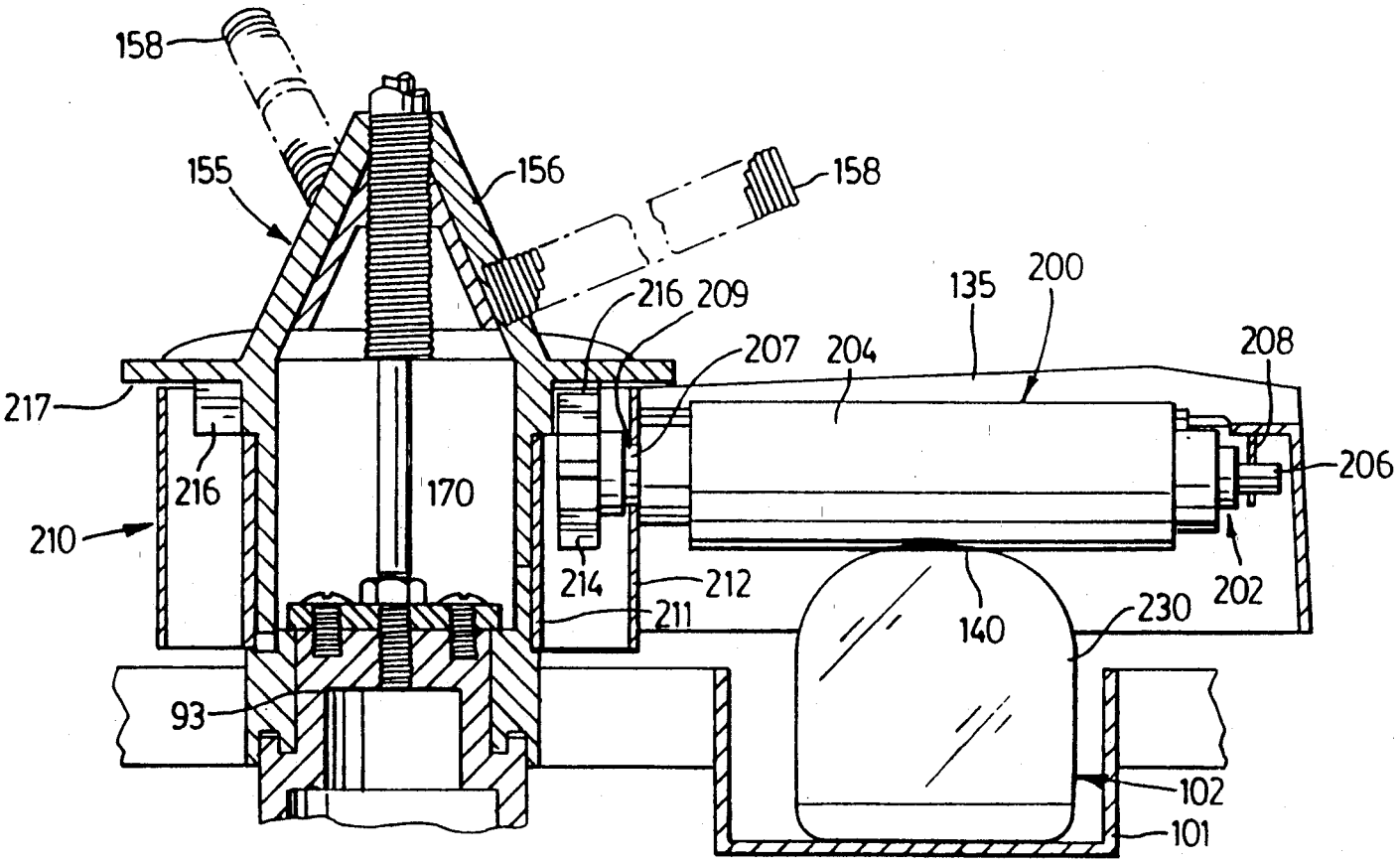
FIG. 4 is a cross-sectional elevation illustrating the assembly of FIG. 3.

Further details concerning the construction and operation of the bulk vendor described thus far are fully set out and illustrated in U.S. Pat. No. 4,534,392. The present invention comprises an improvement in the means for blocking entry into the housing 135 of free floating articles contained in the product bin 14, as illustrated in FIGS. 3 and 4 and described in detail below.

In a preferred embodiment, means for ejecting free floating articles from the entry notch 140 to the housing 135 comprises a resilient rolling member 200 extending across or substantially across the entry notch 140, having its axis in a plane parallel to the plane of the dispensing wheel. The rolling member 200 comprises a shaft 202 carrying resilient cylindrical gripping means 204 composed of rubber or another suitable resilient material. One end 206 of the shaft 202 is rotatably mounted in a flange 208 depending from the top of the housing 135 or in any other convenient fashion. The other end 207 of the shaft 202 extends through a mounting hole 209 disposed through the outer wall 212 of a shroud 210 attached to or integral with the housing 135. The hub 93 of the wheel 80 and the depending flange 170 of the agitator 155 revolve within the inner wall 211 of the shroud 210.

The rolling member 200 is designed to rotate in opposition to the direction of motion of the dispensing wheel. In other words, the top surface of the circular plate 98 passes under the rolling member 200 in a direction opposite to the direction of motion of the bottom surface of the rolling member 200, as shown by arrows in FIG. 3. Preferably this is accomplished by a roller gear 214 formed on the end 207 of the shaft 202, meshing with an actuating gear comprising teeth 216 disposed around the underside of a radial flange 217 formed around the base of the agitator cone 156 and thus revolving with the dispensing wheel. The shroud 210 thus serves not only to provide a surface for mounting the shaft 202 of the rolling member 200, but also to conceal the roller gear 214 and teeth 216, and thus prevent articles from being caught in the gear train and mutilated or otherwise damaged.

The shaft 202 and the roller gear 214 are preferably integrally cast from zinc or another suitable material. Preferably the resilient gripping means 204 is moulded onto the shaft 202 in a conventional fashion.

Figure 5:
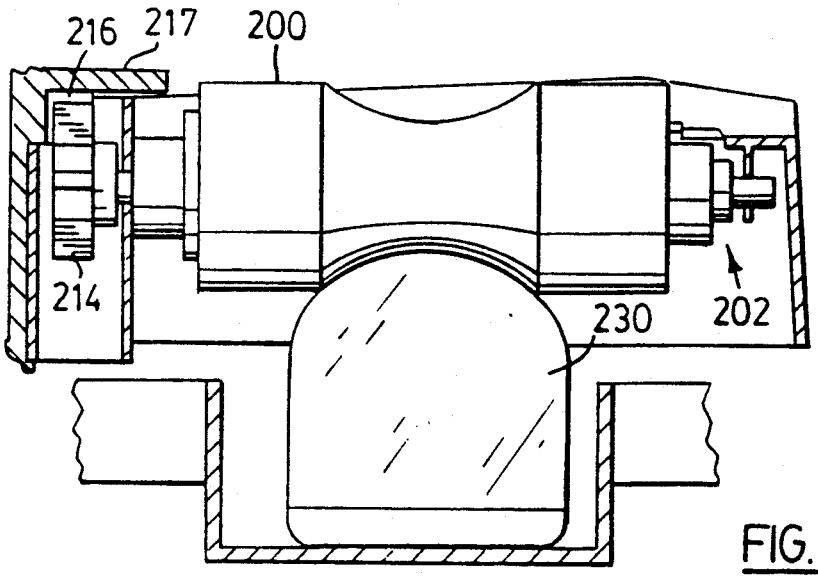
FIG. 5 is a perspective view illustrating a further embodiment of the rolling member of the subject invention.

The shaft 202 of the rolling member 200 is mounted above the circular plate 98 at a height which will permit sufficient clearance to enable an article properly seated in a carrier 102 to pass through the entry notch 140 and into the interior of the housing 135. The resilient gripping means 204 preferably extends slightly below the uppermost height of such an article, as illustrated in FIG. 4, and will thus be slightly depressed as the article passes into the housing 135. The rolling member illustrated in FIGS. 1 to 4 is suitable for vending relatively small articles. For larger articles the resilient gripping means 204 preferably has a concave section, as illustrated in FIG. 5, to more closely approximate the more or less spherical or spheroidal configuration of the vended article and thus deform as little as possible as the article traverses the entry notch 140.

Figure 6:
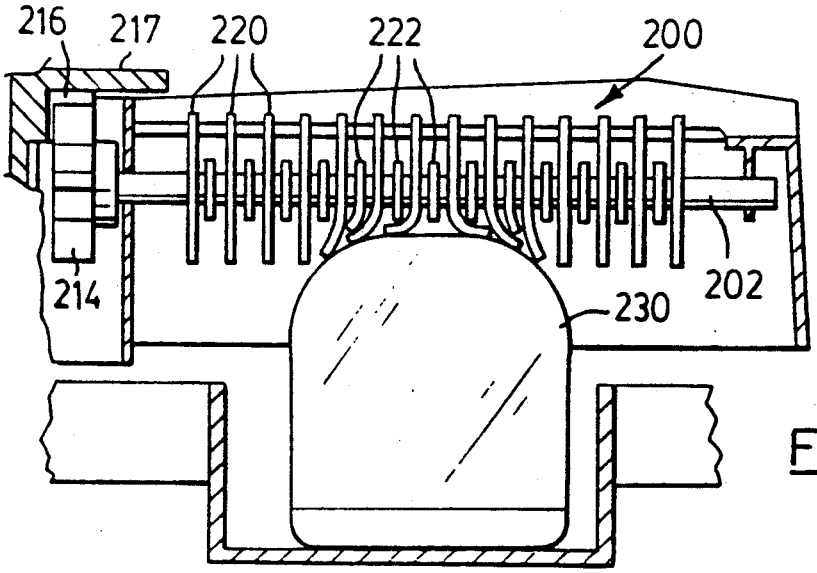
FIG. 6 is a perspective view illustrating a still further embodiment of the rolling member of the subject invention.

A further preferred configuration for the rolling member 200 is illustrated in FIG. 6, comprising a series of smaller and larger resilient rubber discs 220, 222, mounted axially along the shaft 202 in a substantially alternating pattern. In this embodiment the discs 220, 222 not only compress as an article passes underneath the rolling member 200, but they also bend axially, reducing the likelihood of deformation of the article's soft capsule 230.

In operation, loose articles contained in the product bin 14 are deposited in the containers 102, through revolution of the dispensing wheel and agitation of loose articles by the agitator 155. When a coin is deposited into the coin operated gear mechanism 39 and the handle 117 is rotated, the gear 116 causes the wheel 90 to revolve, advancing the next container 102 toward the housing 135. Typically this will cause one or more loose articles in the product bin 14 (i.e. articles not seated within a container 102) to advance toward the housing, entrained in the flow of loose articles caused by revolution of the dispensing wheel and agitator 155. As a loose article approaches the notch 140 it will contact the rolling member 200. The gripping means 204 frictionally grips the capsule 230 of the loose article and, because of the direction and speed of rotation of the rolling member 200, ejects the loose article away from the entry notch 140, upwardly and over the housing in the direction of flow of loose articles in the product bin 14.

It has been determined that the maximum effectiveness for ejecting loose articles from the vicinity of the notch 140 is achieved if the rolling member 200 rotates at a greater speed than the speed of revolution of the dispensing wheel, preferably approximately one-third (30% to 35%) faster.

It can thus be seen that the means of the present invention for excluding loose articles from entering the housing 135, which frictionally grips and actively ejects loose articles in the vicinity of the entry notch 140, is considerably more effective than conventional spring means which merely passively deflects loose articles. The improvement of the subject invention thus not only enables articles having soft capsules to be dispensed from a bulk vendor, but also more effectively prevents articles having rigid capsules from becoming deformed or jammed in the entry notch 140.

The apparatus of the present invention can be retrofitted to existing bulk vendors with relative ease. A conventional housing, as described and illustrated in U.S. Pat. No. 4,534,492, is replaced by a housing 135 of the subject invention having a shroud 210 and a rolling member 200 as illustrated in FIG. 2 mounted as described above. The agitator of a conventional bulk vendor can be fitted with an actuating gear such as a radial flange 217 having teeth 216 adapted to mesh with the roller gear 214, or the agitator can be replaced by an agitator 155 so designed. No other parts of the vendor need be replaced or altered in any way to effectively implement the present invention in an existing bulk vendor.

Preferred embodiments of the subject invention having thus been described, those skilled in the art to which the invention relates will recognize that certain modifications and adaptations may be made to the invention without departing from the spirit and scope thereof. The invention is intended to include all such adaptations and modifications as fall within the scope of the appended claims.

I claim:

1. An apparatus for ejecting free-floating article from the vicinity of an entrance to a delivery chute in a bulk vending machine having a product bin disposed above a revolving dispensing wheel provided with containers for carrying articles to a dispensing aperture and an agitator in the product bin revolving with the dispensing wheel to create a flow of articles in the direction of revolution of the dispensing wheel, comprising:

a housing including a top and sides for shielding the aperture, a side of the housing toward which the dispensing wheel is revolving having an entry notch for permitting an article carried in a container to be delivered into the housing for dispensing through the aperture;

a rolling member having resilient gripping means extending substantially across the notch; and means for rotating the rolling member in opposition to the direction of revolution of the dispensing wheel;

whereby the rolling member frictionally engages articles seated on the dispensing wheel outside of a container and conveys said articles to the top of the housing to be entrained in the flow of articles in the product bin.

2. The apparatus of claim 1 in which the resilient gripping means is composed of rubber.

3. The apparatus of claim 1 in which the resilient gripping means is generally cylindrical.

4. The apparatus of claim 3 in which the resilient gripping means includes a concave section.

5. The apparatus of claim 1 in which the resilient gripping means comprises a series of resilient axially spaced apart discs.

6. The apparatus of claim 1 wherein the resilient rolling member includes a shaft carrying the resilient gripping means, and means for rotating the rolling member includes a roller gear on one end of the shaft engaging an actuating gear revolving with the dispensing wheel.

7. The apparatus of claim 6 wherein the actuating gear is disposed above the roller gear.

8. The apparatus of claim 7 wherein the actuating gear is formed on a radial flange extending around a base of an agitator cone.

9. The apparatus of claim 6 wherein the surface of the rolling member advances at a greater speed than the speed of the advancing dispensing wheel.

10. The apparatus of claim 9 wherein the surface of the rolling member facing the dispensing wheel advances at a speed approximately one-third greater than the speed of the advancing dispensing wheel.

11. A coin operated vending machine comprising:

a housing having a partition between the base and the top dividing the housing into an upper product bin and a lower cash box, the partition having an aperture defining an entrance to a delivery chute and having a spindle protruding upwardly from a central portion thereof;

a dispensing wheel having:

a hub with bearing means at the centre thereof for engaging the spindle, a rim with a plurality of gear teeth about the circumference thereof, and retaining members provided between the hub and the rim defining a plurality of product openings in the wheel;

a coin activated gear mechanism having a handle actuating a transmission gear engaging the teeth on the rim of the dispensing wheel; and means positioned above the dispensing wheel over the aperture for preventing loose articles in the product bin from being dispensed through the aperture, comprising a housing having a top and sides extending from an outer wall of the product bin to the spindle;

the improvement comprising a rolling member having a shaft and resilient gripping means mounted across an entrance to the housing, the shaft being in a plane parallel to the plane of the dispensing wheel, and means for rotating the rolling member as the dispensing wheel revolves, in a direction opposite to the direction of revolution of the dispensing wheel, whereby the rolling member frictionally engages articles seated on the dispensing wheel outside of a container and conveys said articles to the top of the housing to be entrained in the flow of articles in the product bin.

12. The apparatus of claim 11 wherein means for rotating the rolling member includes a roller gear on one end of the shaft, engaging an actuating gear revolving with the dispensing wheel.

13. The apparatus of claim 12 wherein the actuating gear is disposed above the rolling gear.

14. The apparatus of clam 13 wherein the actuating gear is formed on a radial flange extending around a base of an agitator cone.

15. The apparatus of claim 11 in which the resilient gripping member is composed of rubber.

16. The apparatus of claim 11 in which the resilient gripping member is generally cylindrical.

17. The apparatus of claim 16 in which the resilient gripping member includes a concave section.

18. The apparatus of claim 11 in which the resilient gripping member comprises a series of resilient axially spaced apart discs.

19. The apparatus of claim 11 wherein the surface of the resilient rolling member facing the dispensing wheel rotates at a greater speed than the speed of the advancing dispensing wheel.

20. The apparatus of claim 11 wherein the surface of the rolling member facing the dispensing wheel advances at a speed approximately one-third greater than the speed of the advancing dispensing wheel.

* * * * *